US005924588A

United States Patent [19]

Brennan

[11] Patent Number: 5,924,588

[45] Date of Patent: Jul. 20, 1999

[54] CAP AND INTERCHANGEABLE VIAL SYSTEM

[76] Inventor: V. Jack Brennan, 2850 Lombardy Rd., San Marino, Calif. 91108

[21] Appl. No.: 08/958,704

[22] Filed: Oct. 23, 1997

Related U.S. Application Data

[63] Continuation of application No. 08/693,857, Aug. 5, 1996, abandoned, which is a continuation of application No. 08/053,912, Apr. 27, 1993, abandoned.

[51] Int. Cl.[6] ..... B65D 69/00

[52] U.S. Cl. ..... 220/23.83; 220/672; 220/675; 215/206; 206/581; 206/223; 206/536

[58] Field of Search ..... 220/287, 524, 220/669, 672, 675, 23.83, 23.86, 4.27, DIG. 13; 206/528, 536, 540; 215/6, 206, 581, 223

[56] References Cited

U.S. PATENT DOCUMENTS

Re. 29,779 9/1978 Morris .

3,067,896 12/1962 Berg et al. ..... 220/4.27

3,306,493 2/1967 Szajna ..... 206/536

3,623,634 11/1971 Norgard ..... 220/4.27

FOREIGN PATENT DOCUMENTS 538226 6/1955 Belgium .

*Primary Examiner*—Stephen Castellano

*Attorney, Agent, or Firm*—Fitch, Even, Tabin & Flannery

[57] ABSTRACT

A cap and vial system which allows a common cap to be used to seal each of several sizes of pharmaceutical vials, thus precluding the need for pharmacists to maintain an inventory of a differently sized cap for each specific vial size. Each of the vials has a mouth opening of common diameter, with smaller vials being tapered down at a location beneath the mouth opening a greater amount than larger vials which are not tapered down as much. The cap may be reversible to engage with the differently sized vials in a child-resistant manner on one side of the cap, and in a non-child-resistant manner on the other side of the cap.

2 Claims, 4 Drawing Sheets

CAP AND INTERCHANGEABLE VIAL SYSTEM

This is a continuation, of application Ser. No. 08/,693,857 filed Aug. 5, 1996, now abandoned which is a continuation of application Ser. No. 08/053,912, filed Apr. 27, 1993, now abandoned.

FIELD OF THE INVENTION

The present invention pertains to safety closures and containers, and more particularly to safety or child resistant closures and containers used in the pharmaceutical industry.

BACKGROUND OF THE INVENTION

There are at least five or six, commonly used standard sizes of vials commonly used by the pharmaceutical industry. The size of the vial employed is dependent upon the size and quantity of pills to be dispensed in the vial. Hence, it is necessary to produce a range of differently sized vials. Currently, it is necessary to also produce a number of differently sized caps for sealing each of the respective, differently sized, vials. That is, separate sizes of caps are required for sealing specific sizes of vials, with larger diameter caps required for sealing larger vials, and smaller caps required for sealing smaller vials. Accordingly, separate production lines are required for manufacturing each of the differently sized caps. This results in significant expenditure, with each cap production line requiring its own separate tooling investment in molds, plant floor space, operating personnel, and inventories. Also, pharmacists must currently maintain an inventory of differently sized caps for use with respective, differently sized containers or vials.

Hence, it is desirable to provide a cap and vial system which allows a single cap to be used interchangeably with different sizes of vials. This would substantially reduce the amount of storage space required for pharmacists and also substantially reduce the inventory requirements. Additionally, in the pharmaceutical industry it is required in many applications that drugs be dispensed in capped vials which are child-proof, i.e. require complex cap manipulation to release the cap from the vial. However, many consumers such as elderly or arthritic persons cannot perform the requisite complex cap manipulations, and many other consumers need not be concerned with a child tampering with the vial. For these consumers the requirement of repeating the requisite complex cap manipulation upon each cap removal occasion is unnecessarily burdensome. Accordingly, a reversible cap has been developed which engages with the vial on one side of the cap in a child-proof engagement, with the cap being reversible to engage with the vial on the other side of the cap in a non-child-proof, and easy-opening engagement. Such a reversible cap is shown in Morris U.S. Pat. No. Re. 29,779. Hence, it is desirable to provide an interchangeable cap and vial system which employs a cap having the aforementioned reversibility characteristics which can be used with different sizes of vials.

SUMMARY OF THE INVENTION

In accordance with the present invention, a cap and vial system is provided which allows a single, common cap to be used to seal different sizes of vials. Thus, the necessity of producing a different sized cap for each vial size is eliminated, thereby reducing the additional expense associated with production and storage of so many multiple cap sizes.

Several differently sized vials each have the same diameter at their mouth or opening to cooperate with the same size diameter cap. The substantive volume of the vial is changed by having different diameter lower sections in the respective vials to define different volumes for the respective vials. Each vial has an upper section with the mouth and a lower section; these sections are joined by an inclined lateral sidewall portion. This lateral offset sidewall portion is preferably angled with respect to the vertical upper and lower sidewall sections and serves to taper the sidewalls inwardly from the upper section to the lower section. Accordingly, by varying the angle and length of the sidewall section to a different diameter lower section, vials having different volumes are attainable, with each differently sized vial having the same opening diameter. Since each of a plurality of differently sized vials have the same diameter at their opening, a common, single sized cap can be employed to seal each of these differently sized vials. Hence, significant cost savings are realized by the ability to reduce the number of sizes of caps, particularly where the desired cap design is complex and therefore costly.

In accordance with another aspect of the invention, the preferred cap putting different sizes of vials is also reversible, with one side of the cap engageable with the vials in a child-resistant manner requiring complex cap manipulation to release the cap from the vial, and the other side of the cap engageable with the vials in a non-child-resistant manner which allows easy cap removal by the elderly or the like.

In accordance with another aspect of the invention, the cap includes a novel sealing element which forms a moisture resistant seal with the vial when the cap is engaged in its child-resistant mode.

BRIEF DESCRIPTION OF THE DRAWINGS

In the drawings, wherein like elements are referenced alike.

DETAILED DESCRIPTION OF THE PREFERRED EMBODIMENTS

Figure 1:
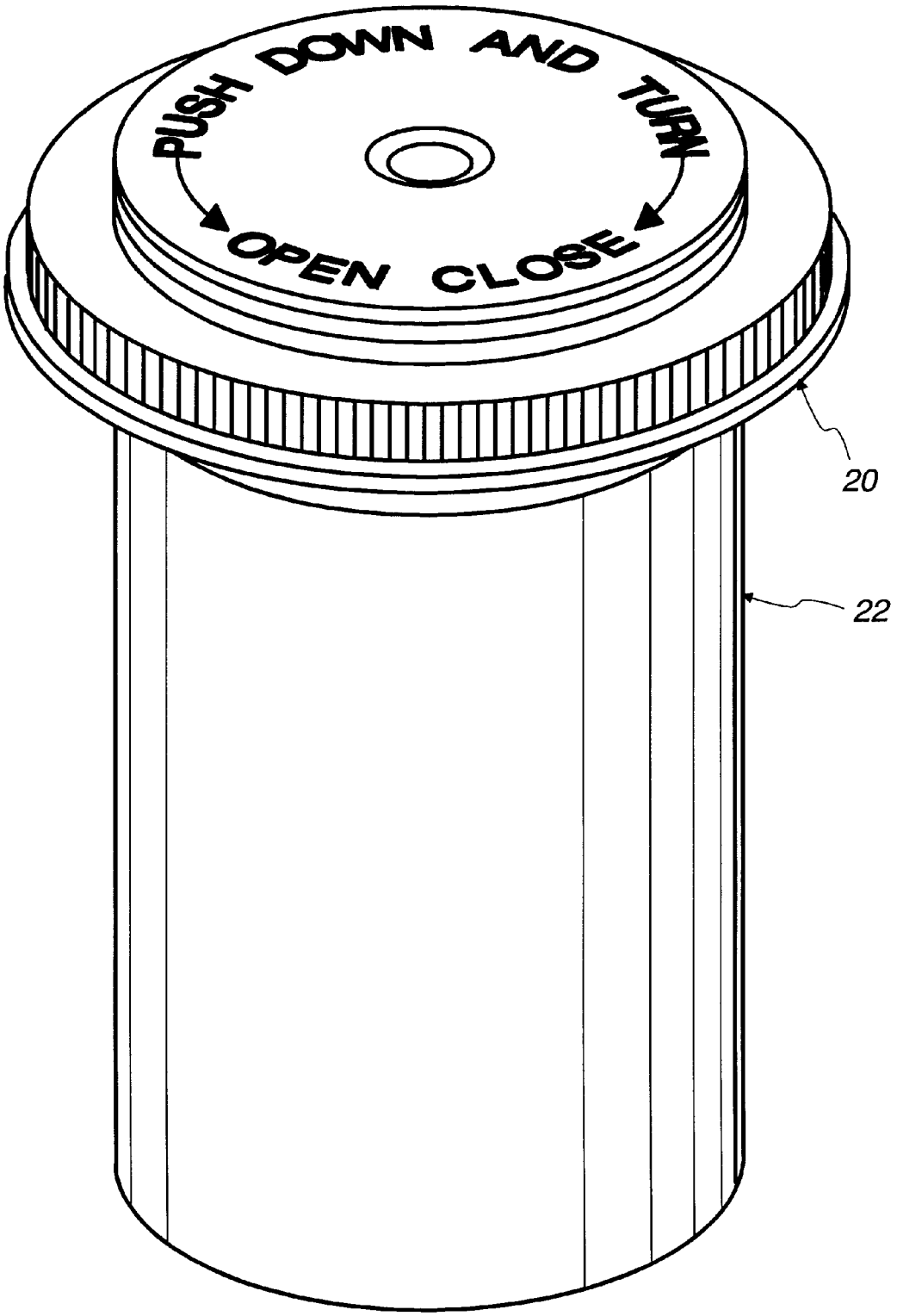
FIG. 1 is an enlarged perspective view of a cap and vial assembly embodying various features of the present invention.

Disclosed in FIGS. 1–9 is a cap and vial system embodying various features of the present invention for storing and dispensing pharmaceuticals. A single cap 20 is sealingly engageable with each of a plurality of differently sized vials, referred to generally by reference numeral 22. The preferred cap 20 is reversible, having a child-resistant mode and a non-child-resistant mode of connection to the vial. The child-resistant side of the cap 20 includes a sealing element, referred to generally by reference numeral 23, which forms a moisture resistant seal with the vial 22 to seal the vial opening 25 when the cap is engaged in its child-resistant mode. The sealing element 23 also functions as a spring element to bias the cap to a locked position when it is in its child resistant mode, as will be discussed in detail further below.

In the illustrated embodiment of the invention, a single large volume vial 24 (FIGS. 2 and 3) and single small volume vial 26 (FIGS. 4 and 5) are shown; however, manifestly, any of a limitless number of differently sized vials 22 may be employed in conjunction with cap 20.

The vials 22 are generally cylindrical and comprise an annular upper, vertical sidewall portion 28 and an annular lower, vertical. sidewall portion 30 offset laterally or radially inwardly from the upper sidewall portion 28. An intermediate lateral offset portion 32 interconnects the upper and lower sidewall portions 28 and 30. The intermediate lateral offset portion 32 is preferably frustoconical, extending at an angle with respect to both the upper and lower sidewall portions 28 and 30. This tapered down intermediate portion 32 has different lengths and inward extent for each of the vials 22 having different volumes, with each of the differently sized vials having the same diameter at their openings 25, thus allowing the same size cap 20 to seal each of the differently sized vials 22.

The vials 22 have an integral circular base 34, the diameter of which is dependent upon the size of the vial. The base 34 includes a recessed central region 36 which provides added structural. rigidity to the base 34. An annular seating ring or bead 38 depends integrally from the base 34, with the vials 22 being supported on the seating ring 38 when standing in their upright positions.

The volume of the vial may be varied by varying the length and angle of the intermediate portion 32 and the diameter of the lower cylindrical section 30. By way of example, the vial 24 of FIGS. 2 and 3 has a short intermediate offset portion 32 and a large diameter lower section, resulting in a relatively large volume; whereas the vial 26 of FIGS. 4 and 5 has a longer intermediate portion 32 and a smaller lower section, resulting in a relatively smaller volume. Though the volumes are significantly different between the vials 24 and 26, both of the illustrated vials 24 and 26 are sealable by the same cap 20.

The cap 20 of the preferred and illustrated embodiment is reversible, having a child-resistant side 40 which engages with the vial 22 in a child-resistant mode which requires complex physical manipulation to release the cap 20 from the vial 22, and a non-child-resistant side 42 which is an easy release mode that does not require complex manipulation to remove the cap 20 from the vial 22.

Figure 9:
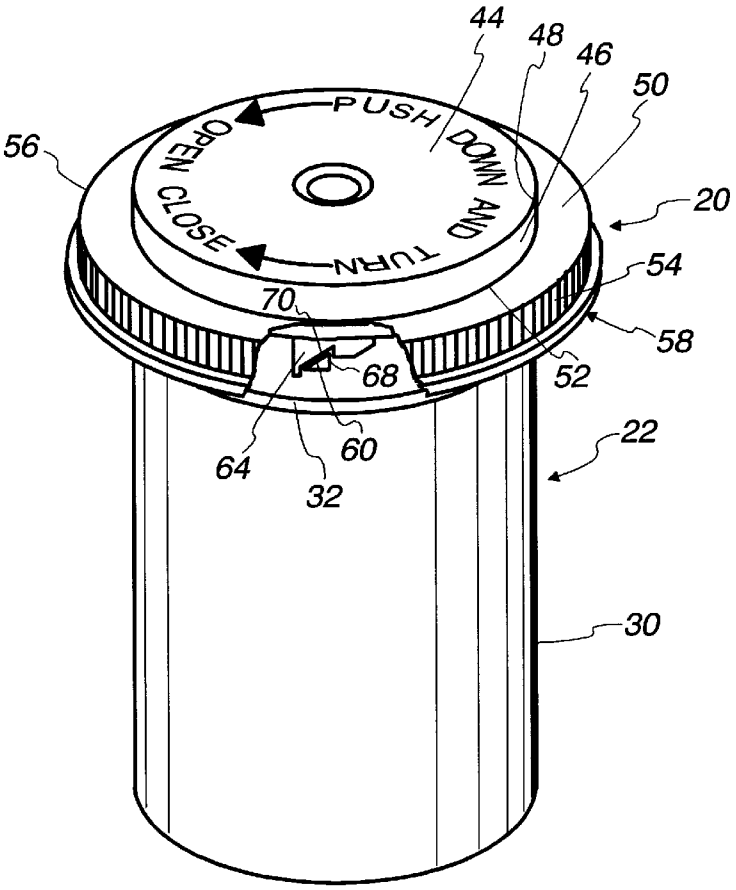
FIG. 9 is a perspective view of the cap and vial assembly of FIG. 8 with the cap engaged.

With reference to FIG. 9, the cap 20 includes a central disk 44 having an annular skirt 46 formed integral with and depending downwardly from the periphery 48 of the central disk 44. An integral annular shoulder 50 extends radially outwardly from the lower end 52 of the sidewall 46. A peripheral gripping flange portion 54 depends downwardly from the periphery 56 of the annular shelf 50. Thus, as best illustrated in FIGS. 2–5, the central disk and annular shelf 44 and 50 extend horizontally, with the sidewall and gripping flange 46 and 54 extending vertically, whereby the cap 20 steps down from the central disk 44 to the gripping flange portion 54. A small bead 58 extends radially outwardly from the lower end of the gripping flange 54 to provide an additional gripping surface for gripping the cap 20 to remove it from the vial 22. The cap engagement and removal is discussed further below.

Figure 2:
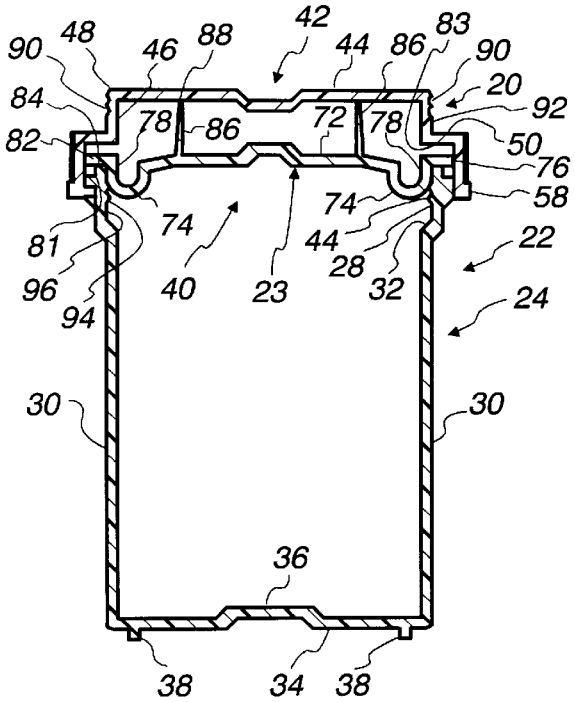
FIG. 2 is a sectional view of the cap and vial assembly of FIG. 1, with the cap engaged in its child-resistant mode.
Figure 3:
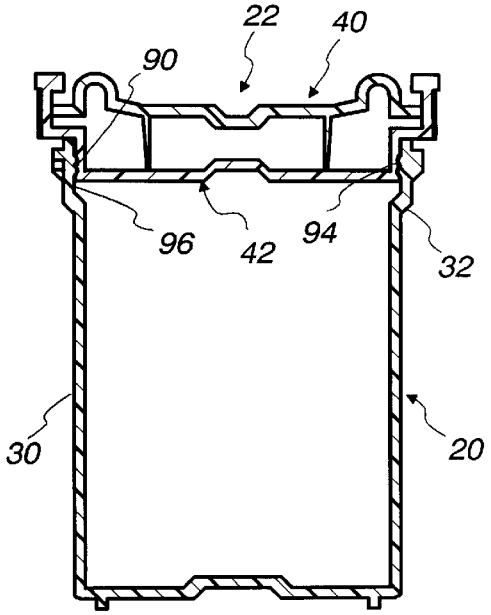
FIG. 3 is a sectional view of the cap and vial assembly of FIG. 1, with the cap engaged in its non-child-resistant mode.
Figure 4:
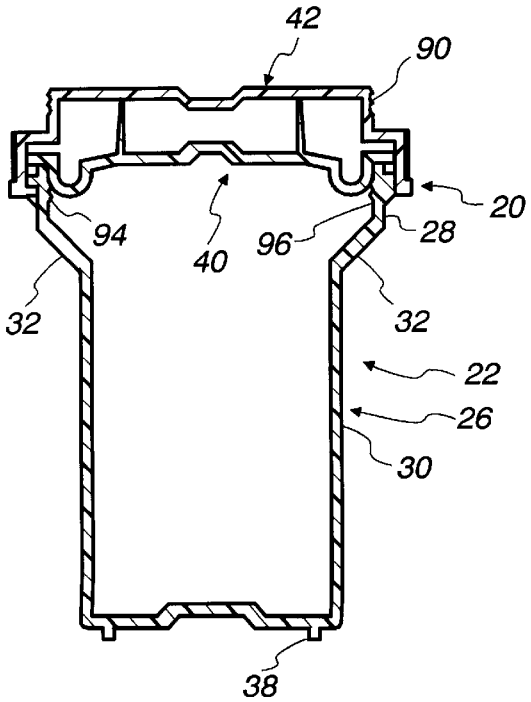
FIG. 4 is a sectional view of a cap and vial assembly employing a smaller vial, with the cap in its child-resistant mode.
Figure 5:
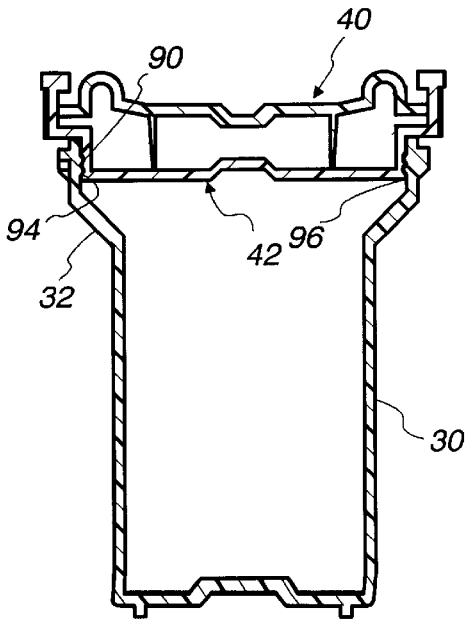
FIG. 5 is a sectional view of a cap and vial assembly employing a smaller vial, with the cap in its non-child-resistant mode.
Figure 6:
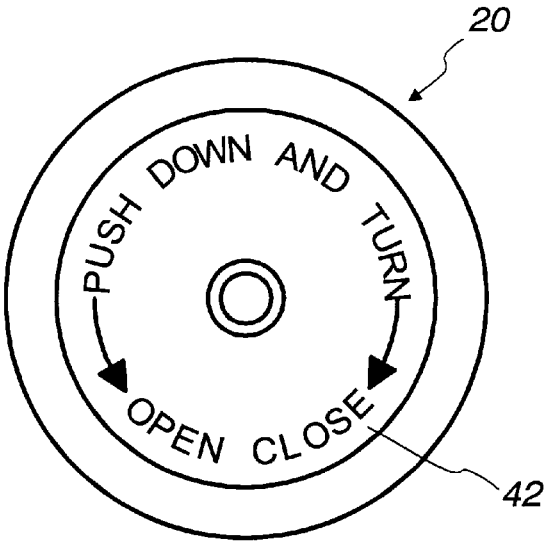
FIG. 6 is a plan view of the cap and vial assembly of FIG. 2.
Figure 7:
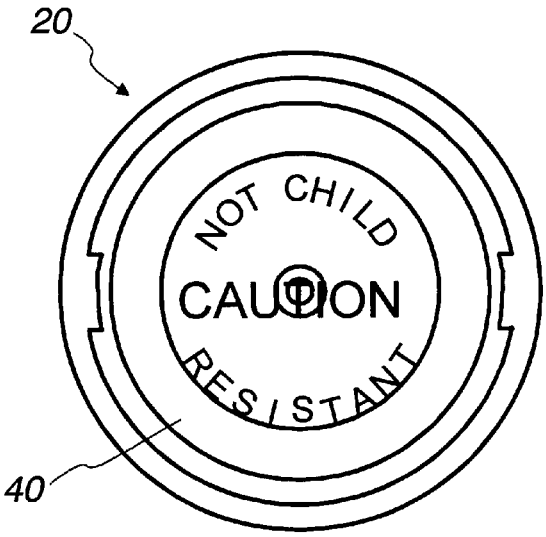
FIG. 7 is a plan view of the cap and vial assembly of FIG. 3.
Figure 8:
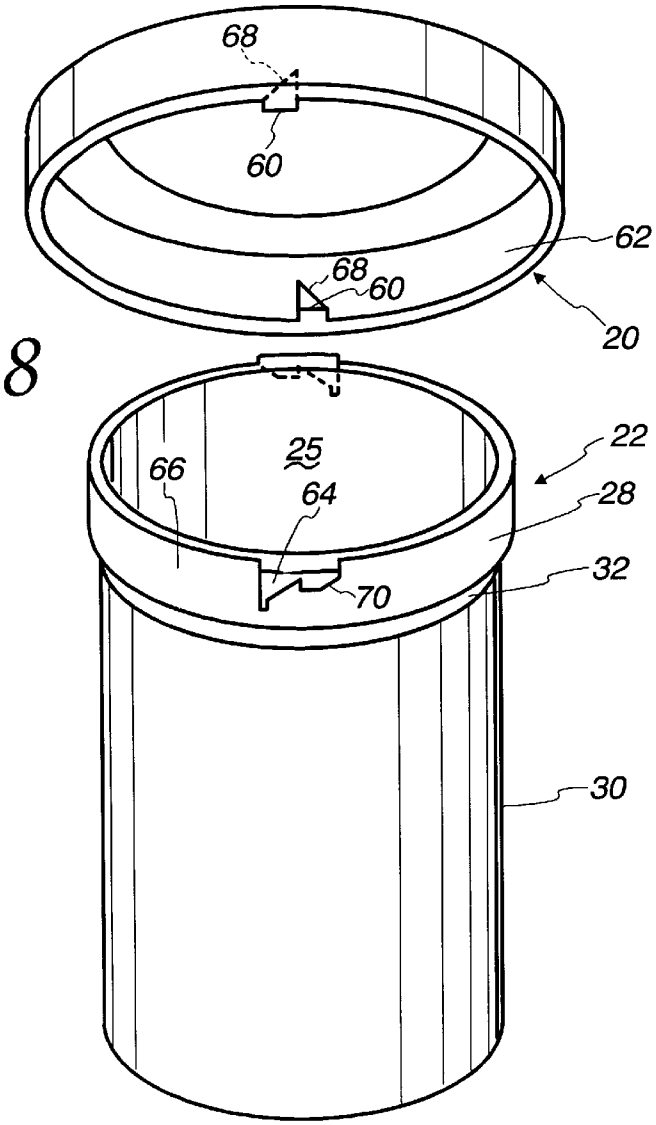
FIG. 8 is an enlarged perspective schematic view of the cap and vial assembly of the present invention with the cap disengaged, illustrating the lug and bayonet child resistant feature.

As mentioned above, the cap 20 is engageable with the vial 22 in both a child-resistant manner (see FIGS. 2 and 4) and a non-child-resistant manner (see FIGS. 3 and 5). A lug-and-bayonet arrangement is employed to engage the cap 20 to the vial 22 in a child-resistant manner. A variety of lug-and-bayonet arrangements are well known in the art. As best seen in FIG. 8, the lug-and-bayonet arrangement of the illustrated cap 20 comprises generally triangular shaped lugs 60 extending radially inwardly from the inner surface 62 of the gripping flange portion 54 of the cap 20. The triangular lugs 60 engage within grooves 63 of bosses 64 which extend radially outwardly from the outer surface 66 of the upper sidewall 28 of the vial 22. Upon rotation of the cap 20 clockwise, the angled portion 68 of the lugs 60 bear against and cam against the angled portions 70 of the bosses 64, whereby the lugs 60 slide past the angled portion 70 of the bosses 64 and into the grooves 63 to be in an engaged position, as shown in FIG. 9. Once the lug 60 is in the engaged position of FIG. 9, vertical portion 68 of the lug 60 bears against vertical portion 70 of the boss 64 to prevent rotation of the cap 20, and thereby maintain the cap 20 in engagement with the vial 22. The drawings illustrate a cap 20 having two lugs 60, however any number of plurality of lugs 60 may be employed without departing from the inventive concepts of the present invention.

To disengage the cap 20 from the vial 22, it is necessary to move the vertical portion 68 of the lug 60 downward beneath the vertical portion 70 of the boss 64, so that the cap may be rotated counterclockwise to move the lugs 60 to a position spaced from the bosses 64. With the lugs 60 spaced from the bosses 64, the cap 20 ay be lifted with the lugs passing between a pair of adjacent spaced bosses and thus the cap is easily removable from the vial 22.

As discussed above, and best seen in FIGS. 2–5, the cap 20 further includes a sealing and spring element 23 which forms a moisture resistant seal with the vial 22 when the child-resistant side 40 of the cap 20 is engaged with the vial 22. The sealing and spring element 23 serves to bias the locking lugs 60 on the cap upwardly into grooves 63 in the container sidewall.

The sealing element 23 is disposed within the cap 20. The sealing element 23 generally comprises a circular disk portion 72 having an annular, arcuate groove 74 formed therein near the periphery 76 of the circular disk portion 72 thereby forming a bellows-like ring that can be flexed to provide biasing spring forces. The arcuate groove 74 is proportioned, and spaced from the periphery 76 of the disk portion 72, such that upon application of the cap 20 to the vial 22, the outer portion 78 of the bellows-like ring bears against the inner surface 80 of the upper sidewall portion 28 of the vial 22.

The diameter of the sealing element 23 is made slightly smaller than the diameter across the inner surface 81 of the gripping flange portion 54 of the cap 20. The sealing element 23 is slidable upward and downward within the cap 20, with its upward movement limited by the lower surface 83 of the annular shelf 50 of the cap 20, and its downward movement limited by the lugs 60 extending inwardly from the gripping flange portion 54 of the cap 20. That is, the lugs 60 act as a detent means to prevent the sealing element 23 from sliding outwardly of the cap 20.

The arcuate outer portion 78 of the arcuate groove 74 serves as a bearing surface against which the upper end 84 of the vial 22 slides upon application of the cap 20 to the vial 22. Hence, upon application of the cap 20 to the vial 22, the outer portion 78 of the arcuate groove 74 is resiliently deflected inwardly by the sidewall 28 upon application of the cap 20 to the vial 22. Thereafter, the outer portion 78 of the arcuate groove 74 remains biased against the inner surface 80 of the upper sidewall 28 throughout engagement of the cap 20 to the vial 22 to provide a moisture resistant sealing of the vial 22. Manifestly, other, non-arcuate grooves may be employed to provide the desired resilient deflection without departing from the inventive concepts of the invention.

Additional moisture resistant sealing of the vial 22 is provided by the peripheral disk portion 82 of the sealing element 23 bearing against the upper rim surface 84 of the vial 22. The sealing element 23 includes an integral annular spacing ring 86 centrally located on the sealing element 23 radially inwardly of the arcuate groove 74. The spacing ring 86 is proportioned so that the free end 88 of the spacing ring 86 contacts underside of the central disk 44 of the cap 20 when the sealing element 23 is slid to a position approximately midway between the lugs 60 and the lower surface 83 of the annular shelf 50 of the cap 20, as shown in FIGS. 2 and 4.

Accordingly, upon application of the cap 20 to the vial 22, the sealing element 23 is pushed upward within the cap 20 by the upper rim surface 84 of the vial 22. The upward movement of the sealing element 23 is stopped when the upper, free end of the spacing ring 86 abuts the underside of the central disk 44 of the cap 20. The cap 20 is designed so that the spacing ring 86 abuts the central disk 44 of the cap 20 prior to full engagement of the cap 20 with the vial 22.

Following abutment of the spacing ring 86 against the central disk 44 of the cap, further downward force on the cap 20 effects movement of the cap 20 relative to the vial 22. As the cap is forced downward, the outer portions of the sealing element 23 are resiliently deflected upwardly by the rim portion 84 of the vial 22, while the central portion of the sealing element 23 is prevented from further upward movement by the spacing ring 86 abutting and bearing against the central disk 44 of the cap 20. Additionally, as discussed above, the outer portion 78 of the arcuate groove 74 is resiliently deflected inwardly by the upper sidewall portion 28 of the vial 22 as the cap 20 is moved further downward with respect to the vial 22.

Upon pushing downward on the cap 20 with sufficient force, and rotating the cap clockwise relative to the vial 22, the lugs 60 of the cap 20 slide into the aforementioned engaged position within the grooves 63 in bosses 64 of the vial 22, as illustrated in FIG. 9. With the cap 20 fully engaged with the vial 22, the outer portion of the sealing element 23 is biased downwardly against the rim surface 84 of the vial 22, and the outer portion 78 of the arcuate groove 74 is biased outwardly against the inner surface of the upper sidewall portion 28 of the vial 22. The central portion of the sealing element 23 is prevented from significant deflection by the integral spacing ring 86 bearing against the central disk 44 of the cap 20.

The resilient deflection of the sealing element 23 when the cap 20 is engaged with the vial 22 deflects the peripheral disk portion 82 of the sealing element 23 upward away from the lugs 60, with the peripheral disk portion 82 of the sealing element 23 also being spaced from the underside 78 of the annular shelf 50 of the cap 20.

Accordingly, after the cap 20 has been fully engaged with the vial 22, exertion of sufficient downward pressure on the cap 20 results in the outer portion of the sealing element 23 being further deflected upwardly, to allow the cap 20 to move downwardly with respect to the vial 22. Sufficient downward movement of the cap 20 relative to the vial 22 moves the lugs 60 of the cap 20 sufficiently downward that the vertical portions 68 of the cap's lugs 60 move past the vertical portions 70 of the vials's bosses 64. While the aforementioned sufficient downward force is maintained on the cap 20, the cap 20 is rotated counterclockwise relative to the vial 22 to move the lugs 60 to a position between adjacent bosses 64 so the cap and lugs may be lifted upwardly from the vial.

Subsequent termination of the downward force on the cap 20 results in the sealing element 23, together with the cap 20, raising upward slightly due to the force of the resiliently deflected sealing element 23 bearing against the rim surface 84 of the vial 22. The cap 20 is then easily removable from the vial 22 by lifting upward on the cap 20, or otherwise moving the cap 20 and vial 22 apart relative to one another.

As seen in FIGS. 2–5, the central disk portion 72 of the sealing element 23 angles downward over the portion thereof immediately radially outward of the spacing ring 86. The degree to which the portion of the central disk 72 outward of the spacing ring 86 is angled with respect to the portion of the central disk 72 inward of the spacing ring 86 is dependent upon the amount of deflection of the sealing element 23 realized in applying the cap 20 into sealing engagement with the vial 22. The sealing element 23 is preferably designed so that the peripheral disk portion 82 of the sealing element extends generally horizontally when the cap 20 is fully engaged with the vial 22. Thereby, the peripheral portion 82 of the sealing element 23 is flush with a substantial portion of the rim surface 84 of the vial 22 to optimize sealing of the vial 22.

Accordingly, the child-resistant side 40 of the cap 20 is engageable with the vial 22 in a child-resistant manner which requires complex , coordinated physical movement of the cap 20 to disengage the cap from the vial 22.

As mentioned above, the cap 20 is reversible and the non-child-resistant side 42 of the cap is engageable with the vial 22 in manner which allows easy disengagement and re-engagement between the cap 20 and the vial 22. Helical screw threads 90 are formed on the exterior surface 92 of the sidewall 46 of the cap 20 and complementary threads 94 are formed on the interior surface 96 of the upper sidewall portion 28 of the vial 22. The diameter of the exterior surface 92 of the sidewall 46 of the cap 20 is proportioned in relation to the diameter of the interior surface 96 of the upper sidewall portion 28 of the vial 22 such that the cap 20 is threadably engageable with the vial 22. Accordingly, the cap 20 is screwed onto the vial 22 by placing the non-child-resistant side 42 of the cap 20 into the opening 25 defined by the rim surface 84 of the vial 22 and then rotating the cap 20 clockwise relative to the vial 22. The cap 20 is just as easily disengageable from the vial 22 by rotating the cap 20 counterclockwise with respect to the vial 22.

While the invention has been described with reference to a preferred embodiment, it will be understood to those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A cap and vial system for use with pharmaceuticals to reduce inventory of caps used in the system, comprising:

a first vial of a predetermined height and having a first mouth of a first mouth predetermined diameter defined by a first upper vertical sidewall section, and having a first lower vertical, cylindrical sidewall section having a first lower vertical sidewall section predetermined diameter to define a first cylindrical storage volume;

a second vial of substantially the same height as the predetermined height of the first vial and having a second mouth of said first mouth predetermined diameter defined by a second upper vertical sidewall section, and having a second lower vertical, cylindrical sidewall section having a second lower vertical sidewall section diameter substantially less than said first lower vertical sidewall section predetermined diameter laterally offset from the second upper sidewall section to define a second storage volume which is substantially less than the first storage volume, with at least one second intermediate lateral offset section joining the second upper and second lower sidewall sections;

the lower vertical sidewall section of the first vial being laterally offset from the first upper sidewall section, a first intermediate lateral offset section joining the first upper and first lower sidewall sections, the respective intermediate lateral offset portions of the first vial and the second vial are both slanted downwardly and inwardly; and a pair of identically sized and shaped caps each sealingly engageable with either the first mouth of the first vial having the first storage volume or said mouth of the second vial having the second, substantially less storage volume to reduce the need for separate caps for each of the first and second vials.

2. A cap and vial system in accordance with claim 1, wherein each cap has a pair of securing means on opposite sides of each cap which are selectively engageable with the vials in a child-resistant manner and a non-child-resistant manner.

* * * * *